US012460376B2

(12) United States Patent
Kassen et al.

(10) Patent No.: US 12,460,376 B2
(45) Date of Patent: Nov. 4, 2025

(54) ELEVATION INCREMENT-DECREMENT WITH SLOPE CONTROL

(71) Applicant: Deere & Company, Moline, IL (US)

(72) Inventors: Daniel M. Kassen, Hazel Green, WI (US); Todd F. Velde, Dubuque, IA (US); Carl J. Koenig, Dubuque, IA (US)

(73) Assignee: Deere & Company, Moline, IL (US)

( * ) Notice: Subject to any disclaimer, the term of this patent is extended or adjusted under 35 U.S.C. 154(b) by 207 days.

(21) Appl. No.: 18/175,704

(22) Filed: Feb. 28, 2023

(65) Prior Publication Data

US 2024/0287755 A1 Aug. 29, 2024

(51) Int. Cl.
*E02F 3/84* (2006.01)
*E01C 19/00* (2006.01)

(52) U.S. Cl.
CPC ..... *E02F 3/845* (2013.01); *E01C 19/004* (2013.01)

(58) Field of Classification Search
CPC . E02F 3/845; E02F 3/844; E02F 3/847; E02F 1/00–9/2891; E01C 19/004; E01C 1/00–2301/50
USPC ..... 701/50
See application file for complete search history.

(56) References Cited

U.S. PATENT DOCUMENTS 8,412,420 B2 4/2013 Ruhter et al.
8,424,632 B2 4/2013 Ruhter et al.
8,548,661 B2 * 10/2013 Wu ..... B60W 10/30 180/65.21
9,227,478 B2 1/2016 Horstman
9,328,479 B1 5/2016 Rausch et al.
9,637,889 B2 5/2017 Elkins
9,777,460 B2 10/2017 Wuisan et al.
9,904,290 B2 2/2018 Pickett et al.
10,030,358 B2 7/2018 Wallace et al.
10,066,367 B1 * 9/2018 Wang ..... E02F 9/262
10,076,939 B2 9/2018 Simon et al.
10,526,766 B2 1/2020 Hageman et al.
10,634,492 B2 4/2020 Beery et al.
10,704,226 B2 7/2020 Yamaguchi et al.
10,883,248 B2 1/2021 Stotlar
10,952,021 B2 3/2021 Kean et al.
10,975,547 B2 4/2021 Mahrenholz
11,053,663 B2 7/2021 Kean et al.
11,124,943 B2 9/2021 Kean et al.
11,499,294 B2 11/2022 Vandegrift et al.
2005/0046599 A1 * 3/2005 Sahm ..... E02F 9/26 340/995.1

(Continued)

FOREIGN PATENT DOCUMENTS

EP 2944727 A2 11/2015

*Primary Examiner* — Mohamed Abdo Algehaim
(74) *Attorney, Agent, or Firm* — Lucian Wayne Beavers; Patterson Intellectual Property Law, PC

(57) ABSTRACT

A system and method are provided for automatically implementing a commanded change in elevation of a ground profile being created by a work vehicle such as a dozer using a slope control system of the work vehicle. A controller calculates an adjusted target value of a mainfall slope and an adjustment distance sufficient to achieve the desired change in elevation and then controls the mainfall slope of the work vehicle to the adjusted target value as the work vehicle advances by the adjustment distance. Then the mainfall slope is automatically returned to its original value.

20 Claims, 5 Drawing Sheets

(56) References Cited

U.S. PATENT DOCUMENTS

2011/0169949 A1 7/2011 Mccain et al.
2012/0239258 A1* 9/2012 Konno ..... E01C 19/004 701/50
2013/0030660 A1* 1/2013 Fujimoto ..... B60K 35/60 701/50
2013/0245896 A1* 9/2013 Velde ..... B60W 30/1882 701/50
2014/0039768 A1* 2/2014 Sawada ..... E02F 9/22 701/50
2014/0064897 A1 3/2014 Montgomery
2014/0236431 A1* 8/2014 Hendrickson ..... A01B 69/007 701/50
2014/0343800 A1 11/2014 Nelson et al.
2015/0165856 A1 6/2015 Horstman
2015/0309006 A1* 10/2015 Kangas ..... G05B 15/02 700/275
2015/0361640 A1* 12/2015 Faivre ..... E02F 3/436 701/50
2016/0362870 A1 12/2016 Elkins
2018/0061040 A1 3/2018 Beery et al.
2018/0245314 A1* 8/2018 Yamaguchi ..... G01C 11/06
2019/0127947 A1* 5/2019 Zent ..... E02F 3/425
2019/0390435 A1* 12/2019 Harada ..... E02F 9/205
2020/0000006 A1* 1/2020 Mcdonald ..... A01B 79/005
2020/0048863 A1* 2/2020 Faivre ..... E02F 3/845
2020/0071909 A1* 3/2020 Harada ..... E02F 3/844
2020/0087887 A1* 3/2020 Kean ..... E02F 9/006
2020/0087888 A1* 3/2020 Kean ..... E02F 3/764
2020/0131740 A1* 4/2020 Hashimoto ..... E02F 9/262
2020/0181874 A1* 6/2020 Mahrenholz ..... E02F 3/6427
2021/0068331 A1* 3/2021 Sporrer ..... A01B 63/16
2021/0216075 A1* 7/2021 Takaoka ..... G05D 1/0274
2021/0372083 A1* 12/2021 Velde ..... E02F 9/205
2022/0049454 A1* 2/2022 Zhao ..... E02F 3/845
2022/0049473 A1* 2/2022 Takaoka ..... E02F 3/7618
2022/0126827 A1 4/2022 Sahoo et al.
2023/0054208 A1* 2/2023 Kuehn ..... E02F 9/205
2024/0026637 A1* 1/2024 Yamazaki ..... E02F 9/265

* cited by examiner

ELEVATION INCREMENT-DECREMENT WITH SLOPE CONTROL

FIELD OF THE DISCLOSURE

The present disclosure relates generally to work vehicles such as for example self-propelled work vehicles which include a ground-engaging blade mounted thereon. More particularly, the present disclosure relates to systems and methods configured to enable a mainfall slope control system to be used to adjust an elevation of a profile being formed by the blade as the machine advances.

BACKGROUND

Work vehicles of this type may for example include dozers, compact track loaders, excavator machines, motor graders, skid steer loaders, and other work vehicles which grade or otherwise modify the terrain or equivalent working environment in some way, and which may be self-propelled in nature.

Existing two-dimensional slope control systems can help a dozer operator achieve a smoother grade faster and with less effort than a manually controlled dozer, but it still takes skill to match the elevation and grade of adjacent passes, and to manage material in low or high spots. This is in part because the input targets are slopes relative to the machine. If an operator starts a pass at a higher elevation than the previous pass, the machine will carry the same slope at the higher elevation unless the operator manually intervenes. Similarly, if an operator wants to cut down to fill an upcoming hole, this requires some manual blade overrides or a lot of manipulation of the slopes in order to achieve this.

For example, FIG. 5 schematically illustrates the prior art technique for making an elevation change using a slope control system. The upper chart of FIG. 5 labeled "Increment/Decrement Button Press" indicates the timing for five incremental slope increase instructions, followed by an intermediate period of operation at the increased target slope, followed by five incremental slope decrease instructions. The middle chart schematically represents the changing "Mainfall Slope Target" and the bottom chart schematically represents the resulting "Ground Elevation."

Changing elevation with existing slope control systems as schematically shown in FIG. 5 requires a lot of button pressing and good timing by a skilled operator to achieve the desired elevation change.

There is a need for improved systems for changing elevation using a slope control system.

BRIEF SUMMARY

The current disclosure provides systems and methods for automatically implementing a commanded change in elevation of a ground profile being created by a work vehicle such as a dozer using a slope control system of the work vehicle. A controller calculates an adjusted target value of a mainfall slope and an adjustment distance sufficient to achieve the desired change in elevation and then controls the mainfall slope of the work vehicle to the adjusted target value as the work vehicle advances by the adjustment distance. Then the mainfall slope is automatically returned to its original value.

In one embodiment a work vehicle includes a vehicle frame, a ground-engaging blade movably connected to the vehicle frame by a linkage assembly configured to allow the blade to be raised and lowered relative to the vehicle frame, a vehicle frame orientation sensor configured to provide a vehicle frame orientation signal indicative of an orientation of the vehicle frame relative to the direction of gravity, and a blade orientation sensor configured to provide a blade orientation signal indicative of an orientation of the blade relative to one of the vehicle frame and the direction of gravity. A controller includes a mainfall slope control in which the controller is configured to determine a target value for the mainfall slope of a profile being formed by the blade as the work vehicle advances, receive the vehicle frame orientation signal and the blade orientation signal, determine a parameter corresponding to a current value of the mainfall slope based at least in part on the vehicle frame orientation signal and the blade orientation signal, and then send a command signal to adjust a position of the blade relative to the vehicle frame to adjust the current value of the mainfall slope toward the target value. The controller further includes an elevation adjustment mode in which the controller is configured to:

- receive an elevation adjustment input command indicative of a desired increase or decrease in an elevation of the profile being formed by the blade as the work vehicle advances;
- temporarily adjust the target value of the mainfall slope to an adjusted target value for an adjustment distance sufficient to achieve the desired increase or decrease in the elevation of the profile being formed by the blade as the work vehicle advances; and
- after the work vehicle has advanced the adjustment distance, return the target value of the mainfall slope to the target value existing prior to the temporary adjustment of the target value.

In another embodiment a method is provided of controlling a work vehicle, the work vehicle including a vehicle frame, a ground-engaging blade movably connected to the vehicle frame by a linkage assembly configure to allow the blade to be raised and lowered relative to the vehicle frame, a vehicle orientation sensor configured to provide a vehicle frame orientation signal indicative of an orientation of the vehicle frame relative to the direction of gravity, a blade orientation sensor configured to provide a blade orientation signal indicative of an orientation of the blade relative to one of the vehicle frame and the direction of gravity, and a controller. The method includes steps of:

- operating the work vehicle in a slope control mode wherein a mainfall slope of a profile of a ground surface formed by the ground-engaging blade as the work vehicle advances is controlled by the controller to an initial target value based at least in part on the vehicle frame orientation signal and the blade orientation signal;
- inputting to the controller by action of a human operator of the work vehicle an elevation adjustment input command representative of a desired change in elevation of the profile;
- determining with the controller an adjusted target value of the mainfall slope and an adjustment distance required for the work vehicle to achieve the desired change in elevation of the profile at the end of the adjustment distance;
- under control of the controller, controlling the mainfall slope to the adjusted target value until the work vehicle has advanced the adjustment distance; and
- then automatically returning to the slope control mode and controlling the mainfall slope to the initial target value after the work vehicle has advanced the adjustment distance.

Numerous objects, features and advantages of the embodiments set forth herein will be readily apparent to those skilled in the art upon reading of the following disclosure when taken in conjunction with the accompanying drawings.

DETAILED DESCRIPTION

Figure 1:
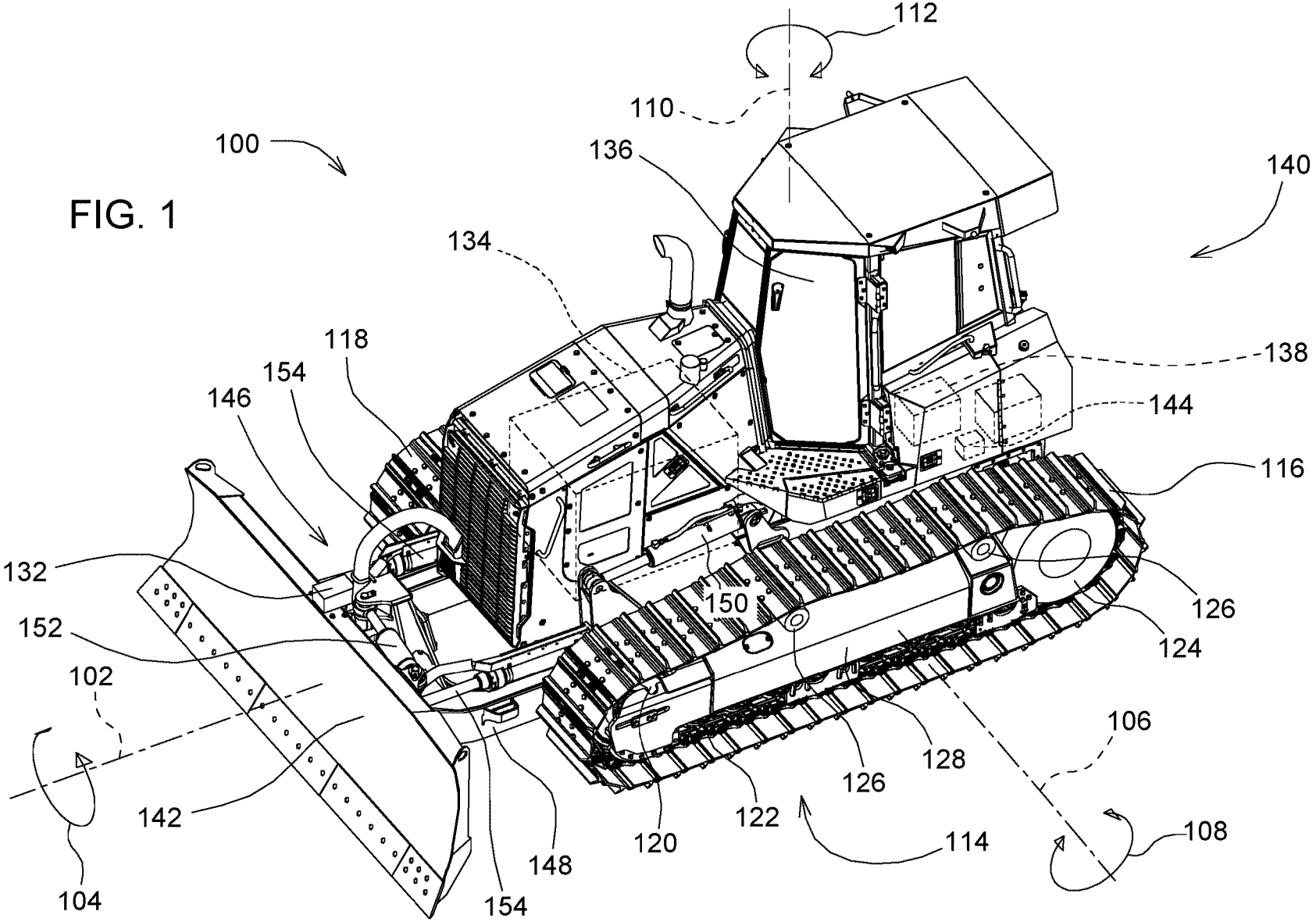
FIG. 1 is a perspective view of a tracked work vehicle incorporating an embodiment of a work vehicle and method as disclosed herein.

FIG. 1 is a perspective view of a work vehicle 100. In the illustrated embodiment, the work vehicle 100 is a crawler dozer, but may in other embodiments within the scope of the present disclosure be alternative work vehicles having a ground-engaging blade or other work implement 142 such as a compact track loader, motor grader, scraper, skid steer, backhoe, and tractor, to name but a few examples. The work vehicle 100 may be operated to engage the ground and grade, cut, and/or move material to achieve simple or complex features on the ground. While operating, the work vehicle 100 may experience movement in three directions and rotation in three directions. A direction for the work vehicle 100 may also be referred to with regard to a longitudinal direction 102, a latitudinal or lateral direction 106, and a vertical direction 110. Rotation for work vehicle 100 may be referred to as roll 104 or the roll direction, pitch 108 or the pitch direction, and yaw 112 or the yaw direction or heading.

An operator cab 136 may be located on a vehicle frame 140. The operator cab and the work implement 142 may both be mounted on the frame 140 so that at least in certain embodiments the operator cab faces in the working direction of the work implement 142, such as for example where the work implement 142 is front-mounted.

The illustrated work vehicle 100 is supported on the ground by an undercarriage 114. The undercarriage 114 includes ground engaging units 116, 118, which in the present example are formed by a left track 116 and a right track 118 but may in certain embodiments be formed by alternative arrangements including wheeled ground engaging units, and provide tractive force for the work vehicle 100. Each track may be comprised of shoes with grousers that sink into the ground to increase traction, and interconnecting components that allow the tracks to rotate about front idlers 120, track rollers 122, rear sprockets 124 and top idlers 126. Such interconnecting components may include links, pins, bushings, and guides, to name a few components. Front idlers 120, track rollers 122, and rear sprockets 124, on both the left and right sides of the work vehicle 100, provide support for the work vehicle 100 on the ground. Front idlers 120, track rollers 122, rear sprockets 124, and top idlers 126 are all pivotally connected to the remainder of the work vehicle 100 and rotationally coupled to their respective tracks so as to rotate with those tracks. The track frame 128 provides structural support or strength to these components and the remainder of the undercarriage 114. In alternative embodiments, the ground engaging units 116, 118 may comprise, e.g., wheels on the left and right sides of the work vehicle.

Each of the rear sprockets 124 may be powered by a rotationally coupled hydraulic motor so as to drive the left track 116 and the right track 118 and thereby control propulsion and traction for the work vehicle 100. Each of the left and right hydraulic motors may receive pressurized hydraulic fluid from a hydrostatic pump whose direction of flow and displacement controls the direction of rotation and speed of rotation for the left and right hydraulic motors. Each hydrostatic pump may be driven by an engine 134 (or equivalent power source) of the work vehicle and may be controlled by an operator in the operator cab 136 issuing commands which may be received by a controller 138 and communicated to the left and right hydrostatic pumps. In alternative embodiments, each of the rear sprockets may be driven by a rotationally coupled electric motor or a mechanical system transmitting power from the engine.

The work implement 142 of the present example is a blade which may engage the ground or material, for example to move material from one location to another and to create features on the ground, including flat areas, grades, hills, roads, or more complexly shaped features. In this embodiment, the work implement 142 of the work vehicle 100 may be referred to as a six-way blade, six-way adjustable blade, or power-angle-tilt (PAT) blade. The blade may be hydraulically actuated to move vertically up or down ("lift"), roll left or right ("tilt"), and yaw left or right ("angle"). Alternative embodiments may utilize a blade with fewer hydraulically controlled degrees of freedom, such as a 4-way blade that may not be angled or actuated in the direction of yaw 112.

The work implement 142 is movably connected to the frame 140 of the work vehicle 100 through a linkage 146 which supports and actuates the blade and is configured to allow the blade to be lifted (i.e., raised or lowered in the vertical direction 110) relative to the frame. The linkage 146 includes a c-frame 148, a structural member with a C-shape positioned rearward of the blade, with the C-shape open toward the rear of the work vehicle 100. The blade may be lifted (i.e., raised or lowered) relative to the work vehicle 100 by the actuation of lift cylinders 150, which may raise and lower the c-frame 148. The blade may be tilted relative to the work vehicle 100 by the actuation of a tilt cylinder 152, which may also be referred to as moving the blade in the direction of roll 104. The blade may be angled relative to the work vehicle 100 by the actuation of angle cylinders 154, which may also be referred to as moving the blade in the direction of yaw 112. Each of the lift cylinders 150, tilt cylinder 152, and angle cylinders 154 may be a double acting hydraulic cylinder.

A control station including a user interface 162 (not shown in FIG. 1) may be located in the operator cab 136. As used herein, directions with regard to work vehicle 100 may be referred to from the perspective of an operator seated within the operator cab 136: the left of work vehicle is to the left of such an operator, the right of work vehicle is to the right of such an operator, the front or fore of work vehicle 100 is the direction such an operator faces, the rear or aft of work vehicle is behind such an operator, the top of work vehicle is above such an operator, and the bottom of work vehicle is below such an operator.

Figure 2:
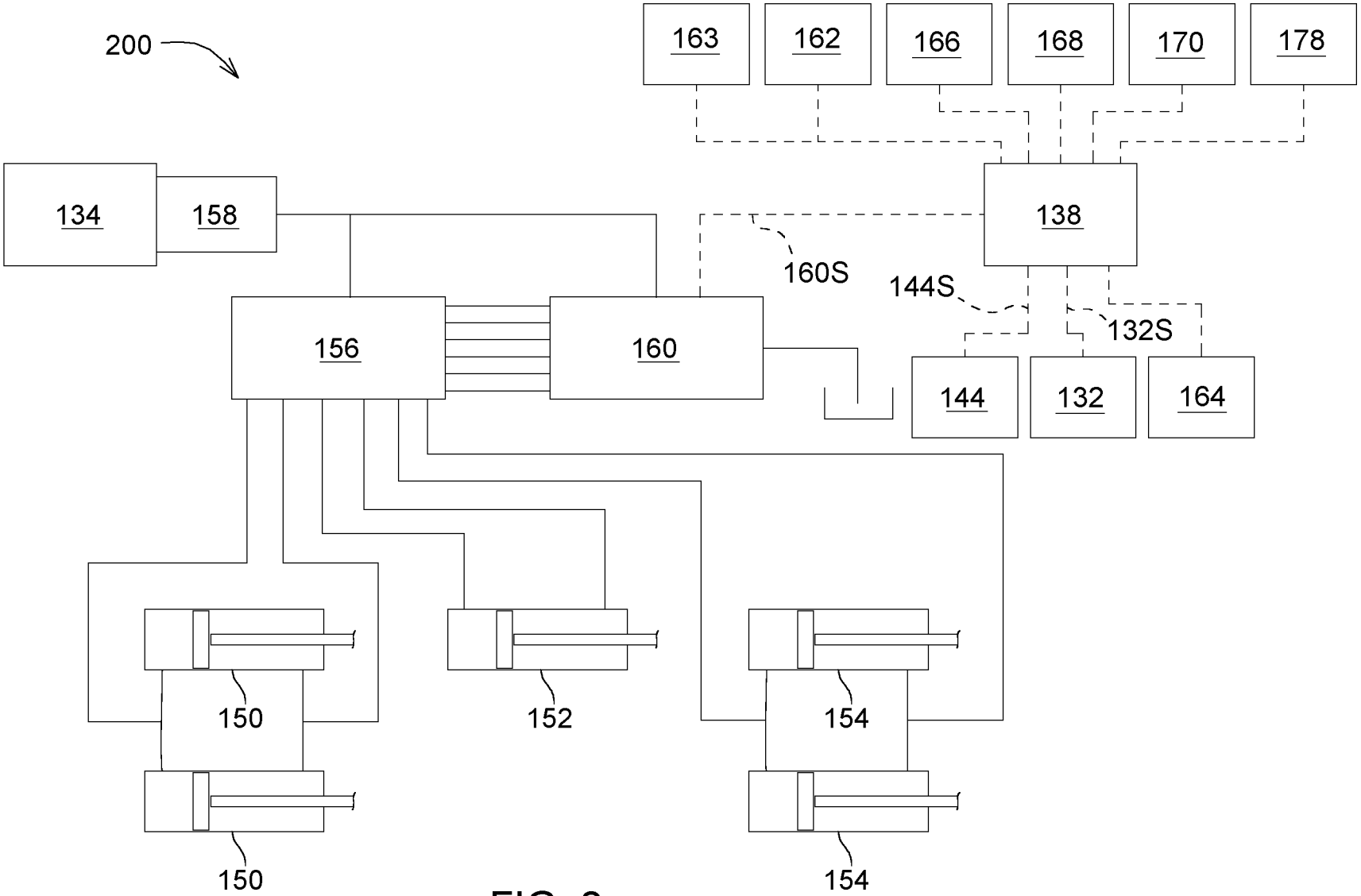
FIG. 2 is a block diagram representing an exemplary control system for the work vehicle according to an embodiment of a system as disclosed herein.

The term "user interface" 162 as used herein may broadly take the form of a display unit and/or other outputs from the system such as indicator lights, audible alerts, and the like. Referring now to FIG. 2, the user interface 162 may further include, or additional components associated with the user interface may include, various user interface tools (e.g., including a first joystick 166 located on the left side of an operator while seated in the operator cab 136, a second joystick 168 located on the right side of an operator while seated in the operator cab 136, and a button 170 which may be located on a control panel, dashboard, or otherwise integrated with one of the joysticks 166, 168 as further described below) for operating various aspects of the work vehicle 100, including operation of the engine, positioning of the work implement 142, and the like. Such an onboard user interface 162 and associated tools 166, 168, 170 may be coupled to a vehicle control system via for example a CAN bus arrangement or other equivalent forms of electrical and/or electro-mechanical signal transmission. Another form of user interface (not shown) may take the form of a display unit (not shown) that is generated on a remote (i.e., not onboard) computing device, which may display outputs such as status indications and/or otherwise enable user interaction such as the providing of inputs to the system. In the context of a remote user interface, data transmission between for example the vehicle control system and the user interface may take the form of a wireless communications system and associated components as are conventionally known in the art.

The illustrated work vehicle 100 further includes a control system 200 including a controller 138. The controller 138 may be part of the machine control system of the working machine, or it may be a separate control module. The controller 138 may include or be functionally linked to the user interface 162 and optionally be mounted in the operators cab 136 at a control panel. It may be understood that the controller 138 described herein may be a single controller having some or all of the described functionality, or it may include multiple controllers wherein some or all of the described functionality is distributed among the multiple controllers.

The controller 138 is configured to receive input signals from some or all of various sensors associated with the work vehicle 100, which may include for example a set of one or more vehicle frame orientation sensors 144 affixed to the frame 140 of the work vehicle 100 and configured to provide signals indicative of, e.g., a mainfall slope and a cross slope of the frame, a set of one or more blade orientation sensors 132 affixed to the work implement 142 of the work vehicle 100 and configured to provide signals indicative of a position and orientation thereof, and one or more sensors 164, for example imaging devices 164, affixed to the work vehicle 100 and configured to capture images associated with components of the work vehicle 100 and/or the surroundings thereof. In alternative embodiments, such sensors 132, 144, 164 may not be affixed directly to the 140, work implement 142, or other components of the work vehicle 100, but may instead be connected through intermediate components or structures, such as rubberized mounts.

Frame orientation sensors 144 may be configured to provide at least a signal indicative of the inclination of the frame 140 relative to the direction of gravity, or to provide a signal or signals indicative of other positions or velocities of the frame, including its angular position, velocity, or acceleration in a direction such as the direction of roll 104, pitch 108, yaw 112, or its linear acceleration in a longitudinal direction 102, latitudinal direction 106, and/or vertical direction 110.

Frame orientation sensors 144 may be configured to directly measure inclination, or for example to measure angular velocity and integrate to arrive at inclination, and may typically, e.g., be comprised of an inertial measurement unit (IMU) mounted on the frame 140 and configured to provide at least a frame inclination (slope) signal, or signals corresponding to the scope of the frame 140, as inputs to the controller 138. Such an IMU may for example be in the form of a three-axis gyroscopic unit configured to detect changes in orientation of the sensor, and thus of the frame 140 to which it is fixed, relative to an initial orientation.

In an embodiment each of the frame orientation sensor 144 and blade orientation sensor 132 may be in the form of an Inertial Measurement Unit (IMU) which may comprise three accelerometers, each measuring linear acceleration in one of three perpendicular directions, and three gyroscopes, each measuring angular velocity in one of three perpendicular directions. In this way, frame orientation sensor 144 and blade orientation sensor 132 may each directly measure linear acceleration or angular velocity in any direction, including the directions of longitude 102, latitude 106, vertical 110, roll 104, pitch 108, and yaw 112.

It may be understood that the various sensors 132, 144 may transmit output signals (e.g. 132S and 144S shown in FIG. 2) representative of the respectively measured values to the controller 138, wherein the controller 138 is further configured to determine for example a position and orientation of the work implement 142 based on the received output signals. The controller 138 may be configured to compare the measured position and orientation of the work implement 142 to respective target values, wherein an error value may be calculated based on a difference between the measured position and a target position and an error value may be calculated based on a difference between the measured orientation and a target orientation. The error signals may then be used by the controller 138 to generate control signals to appropriate actuators as further described herein for minimizing the calculated errors. The measured position of the work implement 142 in an embodiment may correspond to a measured elevation of a ground-engaging portion of the work implement 142 with respect to a reference ground surface or to a reference component associated with the work vehicle 100, whereas the measured orientation in this embodiment may correspond to a measured tilt in a latitudinal/transverse axis of the work implement 142 with respect to the reference ground surface or to the reference component associated with the work vehicle 100.

Figure 6:
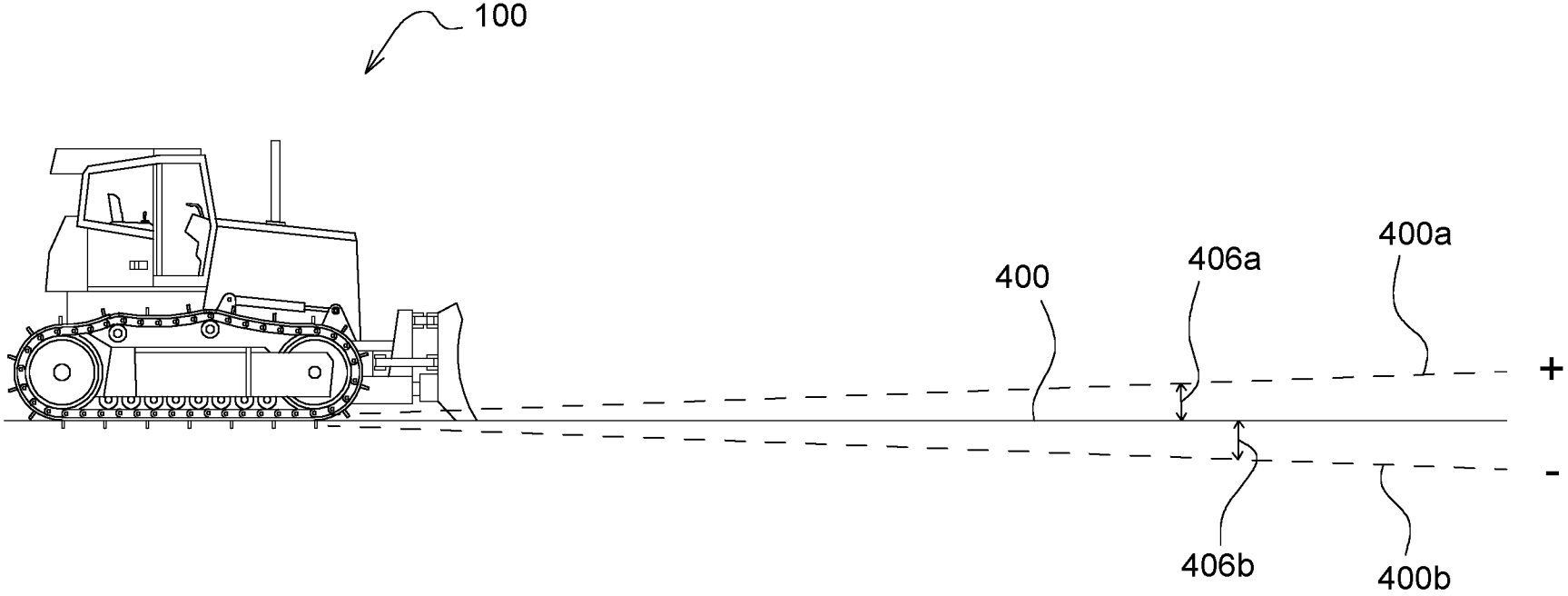
FIG. 6 schematically represents the mainfall slope of a profile of a ground surface being created as a dozer advances.

As is further discussed below the controller may include a Slope Control Mode in which the signals from the frame orientation sensor 144 and the blade orientation sensor 132 are used to control a mainfall slope of a profile of a ground surface being formed by the blade 142 as the work vehicle 100 advances. The term mainfall slope refers to the slope of a top profile 400 of a ground surface in the direction of advance as formed by the advancing work vehicle 100 as schematically shown in FIG. 6. If the ground surface formed by the work vehicle 100 is horizontal as shown in solid lines the mainfall slope is 0 degrees. If the ground surface formed by the work vehicle 100 slopes upward as indicated by the dashed line 400*a* the mainfall slope has a positive slope angle 406*a*. If the ground surface formed by the work vehicle 100 slopes downward as indicated by the dashed line 400*b* the mainfall slope has a negative slope angle 406*b*.

The controller 138 in an embodiment may include or may be associated with a processor, a computer readable medium, a communication unit, data storage 178 such as for example a database network, and the aforementioned user interface 162 or control panel having a display.

Various operations, steps or algorithms as described in connection with the controller 138 can be embodied directly in hardware, in a computer program product such as a software module executed by a processor, or in a combination of the two. The computer program product can reside in RAM memory, flash memory, ROM memory, EPROM memory, EEPROM memory, registers, hard disk, a removable disk, or any other form of computer-readable medium known in the art. An exemplary computer-readable medium can be coupled to the processor such that the processor can read information from, and write information to, the memory/storage medium. In the alternative, the medium can be integral to the processor. The processor and the medium can reside in an application specific integrated circuit (ASIC). The ASIC can reside in a user terminal. In the alternative, the processor and the medium can reside as discrete components in a user terminal.

The term "processor" as used herein may refer to at least general-purpose or specific-purpose processing devices and/or logic as may be understood by one of skill in the art, including but not limited to a microprocessor, a microcontroller, a state machine, and the like. A processor can also be implemented as a combination of computing devices, e.g., a combination of a DSP and a microprocessor, a plurality of microprocessors, one or more microprocessors in conjunction with a DSP core, or any other such configuration.

The communication unit may support or provide communications between the controller 138 and external systems or devices, and/or support or provide communication interface with respect to internal components of the work machine 100. The communications unit may include wireless communication system components (e.g., via cellular modem, WiFi, Bluetooth or the like) and/or may include one or more wired communications terminals such as universal serial bus ports.

Data storage 178 as discussed herein may, unless otherwise stated, generally encompass hardware such as volatile or non-volatile storage devices, drives, memory, or other storage media, as well as one or more databases residing thereon.

The control system 200 may include hydraulic and electrical components for controlling a position of the front-mounted work implement 142. For example, each of the lift cylinders 150, the tilt cylinder 152, and the angle cylinders 154 may be hydraulically connected to a hydraulic control valve 156, which receives pressurized hydraulic fluid from a hydraulic pump 158, which may be rotationally connected to the engine 134, and directs such fluid to the lift cylinders 150, the tilt cylinder 152, the angle cylinders 154, and other hydraulic circuits or functions of the work machine 100. The hydraulic control valve 156 may meter such fluid out, or control the flow rate of hydraulic fluid to, each hydraulic circuit to which it is connected. In alternative embodiments, the hydraulic control valve 156 may not meter such fluid out but may instead only selectively provide flow paths to these functions while metering is performed by another component (e.g., a variable displacement hydraulic pump) or not performed at all. The hydraulic control valve 156 may meter such fluid out through a plurality of spools, whose positions control the flow of hydraulic fluid, and other hydraulic logic. The spools may be actuated by solenoids, pilots (e.g., pressurized hydraulic fluid acting on the spool), the pressure upstream or downstream of the spool, or some combination of these and other elements.

In various embodiments, the controller 138 may send commands to actuate the work implement 142 in a number of different manners. As one example, the controller 138 may be in communication with a valve controller via a controlled area network (CAN) and may send command signals to the valve controller in the form of CAN messages. The valve controller may receive these messages from the controller 138 and send current to specific solenoids within the electrohydraulic pilot valve 160 based on those messages. As another example, the controller may actuate the work implement 142 by actuating an input in the operator cab 136. For example, an operator may use joystick 166 to issue commands to actuate the work implement 142, and the joystick may generate hydraulic pressure signals, pilots, which are communicated to the hydraulic control valve 156 to cause the actuation of the work implement. In such a configuration, the controller 138 may be in communication with electrical devices (e.g., solenoids, motors) which may actuate a joystick 166 in the operator cab. In this way, the controller may actuate the work implement 142 by actuating these electrical devices instead of communicating signals to electrohydraulic pilot valve 160.

The controller 138 of the work machine 100 may be configured to produce outputs, as further described below, to a user interface 142 associated with a display unit for display to the human operator. The controller 138 may be configured to receive inputs from the user interface 142, such as user input provided via the user interface 142. Not specifically represented in FIG. 2, the controller 138 of the work machine 100 may in some embodiments further receive inputs from and generate outputs to remote devices associated with a user via a respective user interface, for example a display unit with touchscreen interface. Data transmission between for example the vehicle control system and a remote user interface may take the form of a wireless communications system and associated components as are conventionally known in the art. In certain embodiments, a remote user interface and vehicle control systems for respective work machines may be further coordinated or otherwise interact with a remote server or other computing device for the performance of operations in a system as disclosed herein.

Slope Control Mode

The controller 138 may be configured to include a Slope Control Mode in which the human operator may input a desired target value for both a mainfall slope and a cross-slope of a profile of the ground surface formed by the blade 142 as the work vehicle 100 advances. Such a Slope Control Mode may for example be configured in accordance with the teachings of U.S. Pat. No. 9,328,479 to Rausch et al. and assigned to the assignee of the present invention, the details of which are incorporated herein by reference.

The present disclosure is concerned with an improvement in the control of mainfall slope using a Slope Control Mode, which allows a work vehicle using a Slope Control Mode to automatically implement a desired elevational change in the mainfall slope of the profile of the ground surface and then return to the previously set value for the mainfall slope once the desired elevational change is achieved.

In the Slope Control Mode, which may also be referred to as a Mainfall Slope Control Mode, the controller 138 may be configured via suitable operable connections to the relevant sensors and actuators, and via suitable software programming to:

- Determine a target value for a mainfall slope of a profile being formed by the blade 142 as the work vehicle advances;
- Receive the vehicle frame orientation signal 144S from the vehicle frame orientation sensor 144;
- Receive the blade orientation signal 132S from the blade orientation sensor 132;
- Determine a parameter corresponding to a current value of the mainfall slope based at least in part on the vehicle frame orientation signal 144S and the blade orientation signal 132S; and
- Send a command signal 160S to adjust a position of the blade 142 relative to the vehicle frame 140 to adjust the current value of the mainfall slope toward the target value.

The determination of the target value for the mainfall slope of the profile may for example include receiving such a target value input by the human operator of the work vehicle 100 via the user interface 162.

The determination of the parameter corresponding to the current value of the mainfall slope based at least in part on the vehicle frame inclination signal 144S and the blade inclination signal 132S may for example include determining a position of the blade 142 relative to the vehicle frame 140.

Elevation Adjustment Mode

The controller 138 may be configured via suitable operable connections to the relevant sensors and actuators, and via suitable software programming, to include an Elevation Adjustment Mode in which the slope control features of the work vehicle may be used to automatically implement a desired elevation change to the ground profile created by the blade 142.

Figure 3:
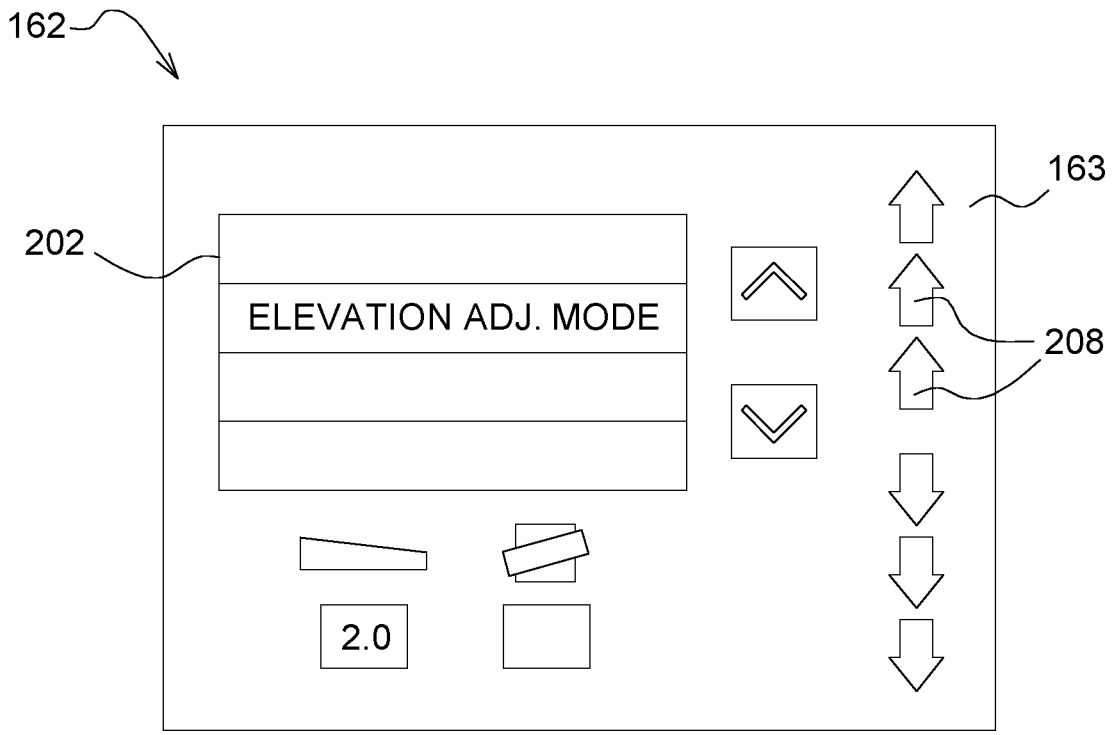
FIG. 3 is a schematic representation of the user interface of the controller including a visual display representative of an input elevation adjustment command.

As a first step in the implementation of the Elevation Adjustment Mode the human operator of the work vehicle 100 may activate the Elevation Adjustment Mode, such as for example by selecting the Elevation Adjustment Mode on a touch screen 202 of the user interface 162 schematically shown in FIG. 3. After activating the Elevation Adjustment Mode, the human operator may input via the user interface 162 an elevation adjustment input command indicative of a desired increase or decrease in an elevation of the profile being formed by the blade 142 as the work vehicle 100 advances.

In one embodiment the elevation adjustment input command may be input using the increase button 204 and/or the decrease button 206 of the user interface 162. The controller may be configured such that each push of the increase button 204 or decrease button 206 generates an incremental elevation adjustment input command representative of a fixed quantitative increase or decrease in the elevation of the profile of the ground surface. For example, each incremental elevation adjustment input command may represent an elevation change of 0.1 inch. Thus, the human operator may input the elevation adjustment input command as a sequence or series of incremental elevation adjustment input commands. Using this example, if the operator desired to increase the elevation of the profile by 0.3 inch, this could be commanded by pushing the up button 206 three times.

Figure 4:
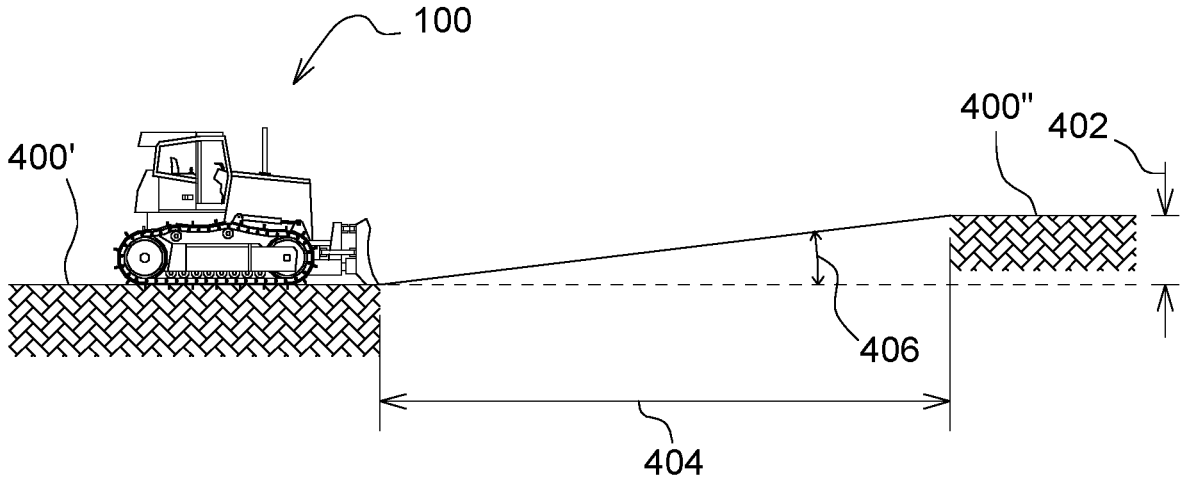
FIG. 4 is a schematic representation of the change in mainfall slope target value and the corresponding adjustment distance sufficient for the work vehicle to achieve the commanded change in elevation of the resulting ground profile.
Figure 5:
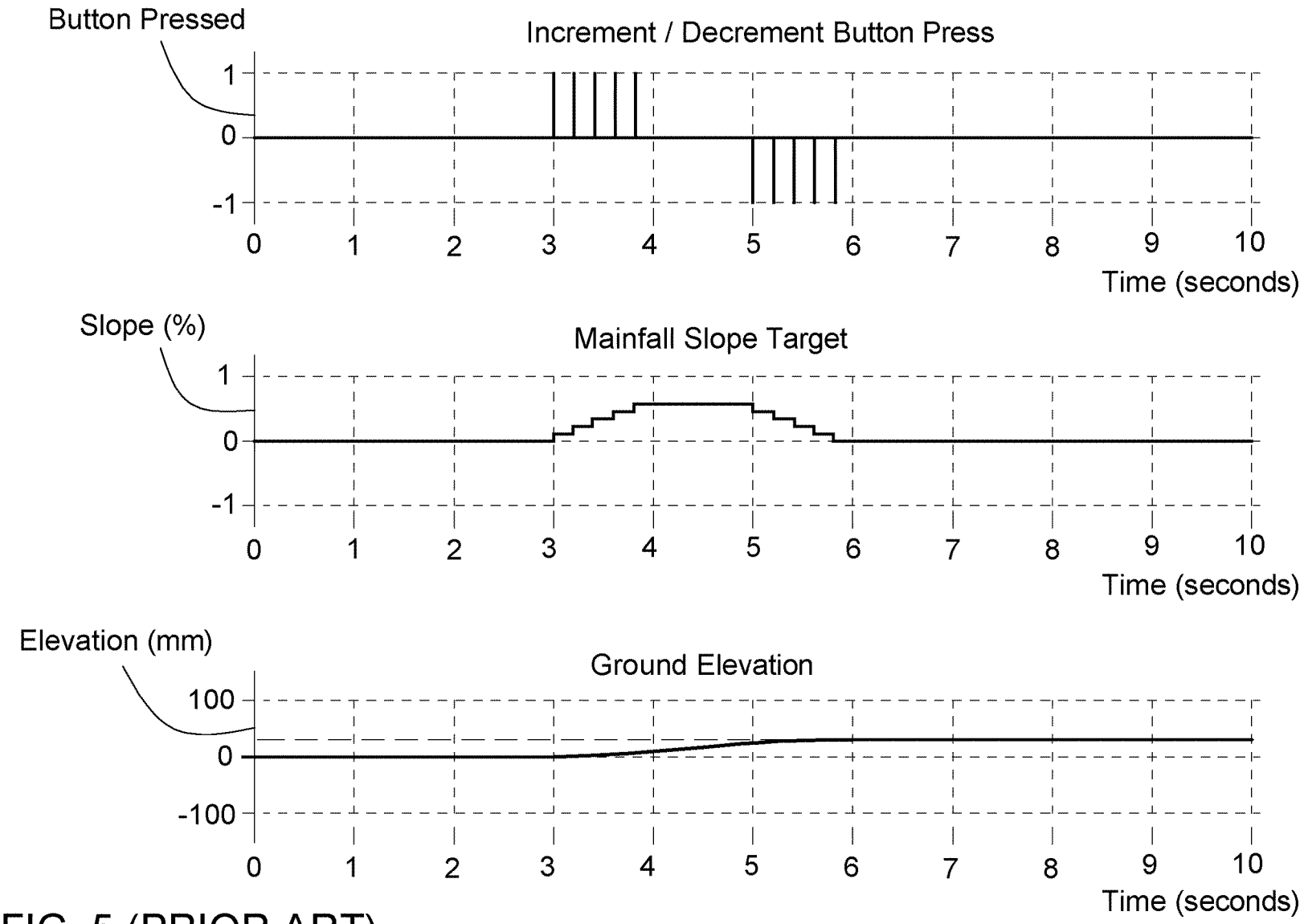
FIG. 5 (PRIOR ART)
FIG. 5 is a schematic representation of a prior art technique for adjusting elevation using a slope control system.

It will be understood that an elevation adjustment input command is intended to direct a change in the work vehicle operation that will transition from the formation of a ground profile 400' at a given mainfall slope to a substantially parallel ground profile 400" at an elevation that is adjusted compared to what the elevation would have been of the initial ground profile if there had been no adjustment. Such an adjustment is schematically shown in FIG. 4 which is further described below.

The display 163 of the user interface 162 may be configured to include a visual display of an indicia 208 representative of an accumulated number and direction of the sequence of incremental elevation adjustment input commands. For example, if the series of incremental elevation adjustment input commands involved three pushes of the increase button 204, this may be indicated by a display of a repeated indicia such as three upwardly directed arrows. Or existing arrows may be illuminated. Or in another example the visual indicia may include an upwardly directed arrow with a numeral "3" displayed in the arrow. The user interface 162 may be configured such that the visual indicia 208 remain visually displayed until such time as the desired elevation change has been achieved or is estimated to have been achieved, and then the indicia 208 may disappear.

The user interface 162 may further be configured such that the human operator may modify an input elevation adjustment command by inputting a further incremental elevation adjustment input command in an opposite direction of a previously input incremental elevation adjustment input command. Thus, after first pushing the increase button 204 three times, and then pushing the decrease button 206 one time, the resulting input elevation adjustment command would correspond to that corresponding to two pushes of the increase button 204.

The controller 138 may be configured to calculate the desired elevation change input by the human operator, based at least in part on a number of the incremental elevation adjustment input commands.

In another embodiment the user interface 162 may be configured to allow the human operator to directly enter in numerical fashion a desired elevation change. For example, the human operator may use a keyboard of the user interface 162 to enter a desired elevation increase of 2.0 inches.

In any of the above embodiments the controller 138 is configured such that after receipt of the elevation adjustment input command the controller may calculate an adjusted target value for the mainfall slope, and a corresponding adjustment distance, sufficient to achieve the desired change in the elevation of the profile as the work vehicle advances a distance equal to the adjustment distance. For example, as schematically shown in FIG. 4, assume that the work vehicle 100 is moving from left to right and has been forming a profile 400'. In the illustrated example for simplicity the initial target value of the mainfall slope is 0 degrees. Then assume an elevation adjustment input command is received indicating a desired elevation increase 402 of 2.0 inches. The controller 138 may then calculate an increased mainfall slope angle 406 and a corresponding adjustment distance 404 sufficient that when the work vehicle advances the adjustment distance 404 the desired elevation change 402 will be achieved. For example, to achieve the elevation increase 402 of 2.0 inches using an increase in mainfall slope 406 of 1 degree the adjustment distance 404 is equal to approximately 114 inches. This calculation may be made based on the relationship that the tangent of the angle 406 is equal to the dimension 402 divided by the dimension 404. Depending on other factors, such as the geometry of the work vehicle 100, the loading of the blade 142, the available space on the worksite, etc. the controller 138 could select a smaller incremental change in mainfall slope angle 406 implemented over a greater distance 404, or a greater incremental change in the mainfall slope angle 406 implemented over a shorter distance 404.

After calculating the adjusted target value of the mainfall slope 406 and the corresponding adjustment distance 404, the controller 138 may temporarily adjust the target value of the mainfall slope to the adjusted target value and maintain that adjusted target value until the work vehicle 100 has advanced by the adjustment distance 404.

After the work vehicle has advanced by the adjustment distance 404 the controller 138 may return the target value of the mainfall slope to the target value which existed prior to the temporary adjustment of the target value.

It is noted that by this technique using the Elevation Adjustment Mode the work vehicle 100 can be controlled to change the overall elevation of the profile of the ground surface being created by the blade 142 without any knowledge of the actual elevation of the profile. The controller estimates a suitable change in mainfall slope and a corresponding adjustment distance and then maintains that change in mainfall slope as the work vehicle advances over the adjustment distance. Then the mainfall slope is returned to its original setting. This allows the human operator to enter the elevation adjustment input command in a simple intuitive fashion corresponding to the desired change in elevation, and then the change is automatically implemented using the existing slope control system and then the mainfall slope is returned to its original setting.

It will be appreciated that the change in elevation effected by the described technique is an estimated change. There is no need for an actual measurement of the actual elevation of the ground profile in any external reference system. The controller calculates a change in target mainfall slope and an adjustment distance which should result in the desired change if everything works as expected.

It will also be appreciated that the adjustment of the target value of the mainfall slope may occur in a single step as schematically shown in FIG. 4, where a single change in the target value of the mainfall slope 406 is maintained for the entire adjustment distance 404, or the adjustment of the target value of the mainfall slope may occur in a series of steps over the adjustment distance 404 with the machine advancing only a portion of the adjustment distance during each step.

It will further be appreciated that grading work may encounter unexpected circumstances which cause the grade which is actually achieved with a given adjustment of position of the blade 142 relative to the vehicle frame 140 to deviate from what was expected. For example, the blade 142 may not be sufficiently loaded with earth, or unexpected high or low spots in the ground surface may be encountered. For this reason, the controller 138 may be configured to continuously monitor the current value of the mainfall slope and to further adjust the target value of the mainfall slope in an open loop control until the controller determines that the actual change in elevation achieved should be approximately equal to that which was desired.

Additionally, the controller 138 may be further configured such that the temporary adjustment of the target value of the mainfall slope is based at least in part on a predicted value of the mainfall slope that is expected to occur in response to a change in the target value. For example, a Model Predictive Control scheme may be used. In a Model Predictive Control system, a model is used to predict the motion of the work vehicle 100 over a window of time into the future, given the current machine position and the current ground speed of the machine and the blade angle at which the blade 142 is held relative to the vehicle frame 140. Based on that predictive model a target value for the mainfall slope may be calculated to achieve the desired change in elevation of the machine. The controller 138 will then make the change in target value for the mainfall slope. At the next control time increment, after the machine has advanced only a portion of the expected adjustment distance 404, the Model Predictive Control system will calculate the change in position of the machine that has actually occurred, and will recalculate a new target value for the mainfall slope based on the new position of the machine. Thus, the system may predict the response which will occur, calculate and implement a new target value for the mainfall slope based on that prediction, check the incremental response which actually occurs after the implementation, then recalculate the optimum target value for the mainfall slope to complete the desired transition. This process may continue until the controller 138 calculates that the desired elevation change has been accomplished, at which point the target value of the mainfall slope is returned to the target value existing prior to the first temporary adjustment of the target value.

In summary, in the Elevation Adjustment Mode the controller 138 is configured to:

receive an elevation adjustment input command indicative of a desired increase or decrease 402 in an elevation of the profile 400 being formed by the blade 142 as the work vehicle 100 advances;

temporarily adjust the target value of the mainfall slope 406 to an adjusted target value for an adjustment distance 404 sufficient to achieve the desired increase or decrease 402 in the elevation of the profile being formed by the blade as the work vehicle advances; and after the work vehicle has advanced the adjustment distance 404, return the target value of the mainfall slope to the target value existing prior to the temporary adjustment of the target value.

Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims. Each disclosed feature or embodiment may be combined with any of the other disclosed features or embodiments.

What is claimed is:

1. A work vehicle, comprising:

a vehicle frame;

a ground-engaging blade movably connected to the vehicle frame by a linkage assembly configured to allow the blade to be raised and lowered relative to the vehicle frame;

a vehicle frame orientation sensor configured to provide a vehicle frame orientation signal indicative of an orientation of the vehicle frame relative to the direction of gravity;

a blade orientation sensor configured to provide a blade orientation signal indicative of an orientation of the blade relative to one of the vehicle frame and the direction of gravity; and a controller including a mainfall slope control mode in which the controller is configured to:

determine a target value for a mainfall slope of a profile being formed by the blade as the work vehicle advances;

receive the vehicle frame orientation signal;

receive the blade orientation signal;

determine a parameter corresponding to a current value of the mainfall slope based at least in part on the vehicle frame orientation signal and the blade orientation signal; and send a command signal to adjust a position of the blade relative to the vehicle frame to adjust the current value of the mainfall slope toward the target value; and wherein the controller further includes an elevation adjustment mode in which the controller is configured to:

receive an elevation adjustment input command indicative of a desired increase or decrease in an elevation of the profile being formed by the blade as the work vehicle advances;

temporarily adjust the target value of the mainfall slope to an adjusted target value for an adjustment distance sufficient to achieve the desired increase or decrease in the elevation of the profile being formed by the blade as the work vehicle advances; and after the work vehicle has advanced the adjustment distance, return the target value of the mainfall slope to the target value existing prior to the temporary adjustment of the target value.

2. The work vehicle of claim 1, further comprising:

an operator input interface configured such that a human operator may input the elevation adjustment input command as a sequence of incremental elevation adjustment input commands.

3. The work vehicle of claim 2, wherein:

each of the incremental elevation adjustment input commands is representative of a fixed quantitative increase or decrease in the elevation of the profile.

4. The work vehicle of claim 3, wherein:

the operator input interface includes a visual display of an indicia representative of an accumulated number and direction of the sequence of incremental elevation adjustment input commands.

5. The work vehicle of claim 4, wherein:

the operator input interface is configured such that the indicia remains visually displayed until the work vehicle has advanced the adjustment distance and then the indicia disappear.

6. The work vehicle of claim 2, wherein:

the operator input interface is configured such that the human operator may modify an input elevation adjustment command by inputting a further incremental elevation adjustment input command in an opposite direction of a previously input incremental elevation adjustment input command.

7. The work vehicle of claim 2, wherein:

in the elevation adjustment mode the controller is further configured to calculate a desired elevation change based at least in part on a number of the incremental elevation adjustment input commands.

8. The work vehicle of claim 1, wherein:

in the elevation adjustment mode the controller is further configured to calculate the adjusted target value and the adjustment distance sufficient to achieve the desired increase or decrease in the elevation of the profile.

9. The work vehicle of claim 1, wherein:

in the elevation adjustment mode the controller is further configured such that the temporary adjustment of the target value of the mainfall slope is done in an open loop control based on a continuous monitoring of the current value of the mainfall slope.

10. The work vehicle of claim 1, wherein:

in the elevation adjustment mode the controller is further configured such that the temporary adjustment of the target value of the mainfall slope is based at least in part on a predicted value of the mainfall slope.

11. The work vehicle of claim 1, wherein:

in the elevation adjustment mode the controller is further configured such that the temporary adjustment of the target value of the mainfall slope occurs in a series of steps, and the work vehicle advances a portion of the adjustment distance during each step.

12. A method of controlling a work vehicle, the work vehicle including a vehicle frame, a ground-engaging blade movably connected to the vehicle frame by a linkage assembly configure to allow the blade to be raised and lowered relative to the vehicle frame, a vehicle orientation sensor configured to provide a vehicle frame orientation signal indicative of an orientation of the vehicle frame relative to the direction of gravity, a blade orientation sensor configured to provide a blade orientation signal indicative of an orientation of the blade relative to one of the vehicle frame and the direction of gravity, and a controller, the method comprising:

operating the work vehicle in a slope control mode wherein a mainfall slope of a profile of a ground surface formed by the ground-engaging blade as the work vehicle advances is controlled by the controller to an initial target value based at least in part on the vehicle frame orientation signal and the blade orientation signal;

inputting to the controller by action of a human operator of the work vehicle an elevation adjustment input command representative of a desired change in elevation of the profile;

determining with the controller an adjusted target value of the mainfall slope and an adjustment distance required for the work vehicle to achieve the desired change in elevation of the profile at the end of the adjustment distance;

under control of the controller, controlling the mainfall slope to the adjusted target value until the work vehicle has advanced the adjustment distance; and then automatically returning to the slope control mode and controlling the mainfall slope to the initial target value after the work vehicle has advanced the adjustment distance.

13. The method of claim 12, wherein:

in the inputting step the human operator inputs the elevation adjustment input command as a sequence of incremental elevation adjustment input commands.

14. The method of claim 13, wherein:

each of the incremental elevation adjustment input commands is representative of a fixed quantitative change in the elevation of the profile.

15. The method of claim 14, further comprising:

visually displaying on an operator input interface a repeated indicia representative of an accumulated number and direction of the sequence of incremental elevation adjustment input commands.

16. The method of claim 15, further comprising:

visually displaying the indicia until the work vehicle has advanced the adjustment distance and then causing the indicia to disappear.

17. The method of claim 13, further comprising:

modifying an input elevation adjustment command by inputting a further incremental elevation adjustment input command in an opposite direction of a previously input incremental elevation adjustment input command.

18. The method of claim 13, further comprising:

calculating with the controller a desired elevation change based at least in part on a number of the incremental elevation adjustment input commands.

19. The method of claim 12, further comprising:

the determining of the adjusted target value of the mainfall slope and the adjustment distance is continuously updated in an open loop control based on a continuous monitoring of the current value of the mainfall slope.

20. The method of claim 12, wherein:

the determining of the adjusted target value of the mainfall slope and the adjustment distance is based at least in part on a predicted value of the mainfall slope.

* * * * *